US005324392A

United States Patent [19]

Tate et al.

[11] Patent Number: 5,324,392

[45] Date of Patent: Jun. 28, 1994

[54] EXTENDABLE AND HEAT SHRINKABLE POLYAMIDE MONO-FILAMENT FOR ENDLESS FABRIC AND ENDLESS FABRIC

[75] Inventors: Takuo Tate; Taketoshi Watanabe; Hiroyuki Nagura, all of Tokyo, Japan

[73] Assignee: Nippon Filcon Co., Ltd., Tokyo, Japan

[21] Appl. No.: 668,299

[22] Filed: Mar. 14, 1991

Related U.S. Application Data

[63] Continuation-in-part of Ser. No. 609,901, Nov. 5, 1990.

[51] Int. Cl.[5] ..... D21F 1/10

[52] U.S. Cl. ..... 162/348; 162/358.1; 162/358.2; 162/900; 162/901; 162/902; 162/903; 428/229; 428/225; 428/257; 428/258; 428/259

[58] Field of Search ... 162/DIG. 1, 348, 358.1-358.2, 162/272, 273, 274, 900-903; 428/229, 225, 257, 258, 259; 139/383

[56] References Cited

U.S. PATENT DOCUMENTS

| | | | |
|---|---|---|---|
| 3,905,863 | 9/1975 | Ayers | 162/113 |
| 4,229,500 | 10/1980 | Adachi | 528/323 |
| 4,301,102 | 11/1981 | Fernstrom et al. | 264/151 |
| 4,640,741 | 2/1987 | Tsuneo | 428/255 |
| 5,116,478 | 5/1992 | Tate et al. | 162/903 |

FOREIGN PATENT DOCUMENTS

| | | |
|---|---|---|
| 8132108 | 6/1983 | Japan . |
| 60-52616 | 3/1985 | Japan . |
| 63-227886 | 9/1988 | Japan . |
| 1-250414 | 10/1989 | Japan . |

*Primary Examiner*—W. Gary Jones
*Assistant Examiner*—Brenda Lamb
*Attorney, Agent, or Firm*—Beveridge, DeGrandi, Weilacher & Young

[57] ABSTRACT

An extendable and heat shrinkable polyamide monofilament which has an extension of 6% or more to a loading variation in the range of 1.25 g/d-1.75 g/d and a heat shrinkage factor of 7% or more on immersing said monofilament into boiling water. The recited polyamide monofilament is woven into a wear-resistant fabric such as a papermaking fabric.

12 Claims, 5 Drawing Sheets

EXTENDABLE AND HEAT SHRINKABLE POLYAMIDE MONO-FILAMENT FOR ENDLESS FABRIC AND ENDLESS FABRIC

REFERENCE TO A RELATED APPLICATION

This is a continuation-in-part of our copending application Ser. No. 07/609,901 filed Nov. 5, 1990 which is relied on and incorporated herein by reference.

BACKGROUND OF THE INVENTION

The present invention relates to an extendable and heat shrinkable polyamide mono-filament used for making endless fabrics and a wear-resistant endless fabric having arranged therein an extendable and heat shrinkable polyamide mono-filament; and, in particular the invention relates to a wear-resistant paper making fabric.

Conventional endless fabrics include many fabrics such as a belt conveyor, a dehydration conveyor, a filtration fabric, a power transmitting belt, a dryer canvas for paper making, a felt for paper making or a fabric for paper making. All of these endless fabrics have problems in that they extend in the warp direction and shrink in the weft direction, that is, draw up in length while shrinking in width because of the application of strong tensile forces in the warp direction in actual use. Further, these fabrics are poor in attitude stability because they also draw up in length while shrinking in width with loading in the vertical direction. Furthermore, they also have a problem in that the fabrics are required to have a large resistance to wear because they are worn away by contact with driving rolls or controlling rolls during running of the machinery. They are also required to have a smooth running surface for smooth running and a flat upper surface for carrying something on the fabric. These problems are common to endless fabrics, however, satisfactory countermeasures have not hitherto been found for solving the problems. The present invention has successfully solved these problems.

The aforementioned requirements are particularly needed for making fabrics used to made endless belts for use in paper making processes. The fabrics for paper making are also required to have properties described hereinafter which are unique to paper making in addition to the aforementioned properties. The description of the common problems described above referring to fabrics for paper making applies to most endless fabrics as do the solutions to the problems. Thus, the present invention is described with reference to a fabric for paper making as a typical example.

There have hitherto been set out many problems in addition to the aforementioned relating to fabrics for paper making. These problems are roughly classified into:

(a) problems relating to the quality of the paper itself such as the prevention of wire marks or satisfactory intertwinement of paper fibers or problems of yields in paper making;

(b) the improvement of the resistance to wear or the extension of the working life of a fabric; and (c) problems of good water drainage property.

These problems relate to each other in many points, i.e. the problems of:

(a) being closely related to the structure of the paper making surface of the fabric;

(b) being related to the structure of the running surface of the fabric; and (c) being related to the whole fabric.

There have hitherto been proposed many solutions to problem (a). Nevertheless, the investigations that have been carried out have not been sufficient for the problem of (b), that is, the improvement of the resistance to wear of fabrics for paper making; the only exception being preventing the warp from wear by making the paper making fabric with a running side of the weft wearing type. In recent years, there have been increased requirements such as the increase in the rate of paper making, the increase in the amount of loading fillers or the increasing necessity of producing neutral paper. Thus, the resistance to wear of the fabric for paper making has become an issue in the industry.

In general, endless fabrics including fabrics for paper making desirably have the wear resistant weft on the running surface from the viewpoint of the attitude stability of the fabric in use and the extension of its working life. This is because the wearing of the warp causes a change in the size of the fabric and finally the break of the warp. This further causes the direct break of the fabric itself, so that a paper making fabric of a warp wearing type has a short working life.

For the purpose of improving the resistance to wear, a polyamide yarn having resistance to wear has been conventionally employed as a weft. However, such an attempt did not change the substantial structure of the fabric but only utilized the properties of a material to be used, and thus any epoch-making advantageous effects could not be expected from the fabric. On the other hand, a disadvantage of poor attitude stability was found in fabrics for paper making composed of a polyamide yarn.

Therefore, fabrics for paper making which were less extendable and excellent in attitude stability were conventionally constructed by using a polyester yarn having an excellent rigidity as either a warp or a weft.

Also, in such conventionally used fabrics for paper making, a yarn having a large diameter was used as a weft on the running side of the fabrics in order to satisfy the aforementioned requirements. Such an attempt was successful to a certain extent in obtaining improvement of the resistance to wear. However, these attempts lead to an imbalance between the weft and the warp because of the larger diameter of the weft. Too many disadvantages were present to be used in practice such as the deterioration of the crimping ability or the appearance of wire marks.

Furthermore, as will be understood from the aforementioned problem (c), the water drainage property is also affected by the change of the structure of a fabric, and all problems will not be solved by such temporary means.

In view of such conventional technical problems, the present inventors have invented a special, extendable and heat shrinkable polyamide monofilament which is excellent in resistance to wear, attitude stability and surface smoothness effect for the construction of an endless fabric. This has improved the structure of a fabric for paper making in the form of an endless fabric with use of the filament to improve the resistance to wear, and also improved the performance in making paper from the standpoint of water drainage property and the wire-marking property.

SUMMARY OF THE INVENTION

In its broadest aspects, the present invention relates to an extendable and heat shrinkable polyamide monofilament which has an extension of 6% or more when subjected to a loading variation in the range of 1.25 g/d–1.75 g/d and a heat shrinkage factor of 7% or more on immersing said monofilament into boiling water. In general, this is determined on applying a load at a rate of 2 mm/min.

Another aspect of the invention relates to an endless fabric containing as a weft the extendable and heat shrinkable polyamide monofilament defined above. Of special importance is a wear-resistant fabric for paper making, containing an extendable heat shrinkable polyamide monofilament as described, at least as a weft.

The endless multiple weft-layer fabric of the invention can have wefts arranged in upper and lower layers, wherein the extendable and heat shrinkable polyamide monofilament as described is arranged at least as a weft of the endless multiple weft-layer fabric. Preferably the the extendable and heat shrinkable polyamide monofilament is arranged as a weft is on the running surface of the endless multiple weft-layer fabric.

A further aspect of the invention relates to wear-resistant multiple weft-layer fabrics for paper making having wefts arranged in the multiple layers of the upper paper making surface and the lower running surface, wherein the extendable and heat shrinkable polyamide monofilament as described is arranged at least as a weft of the multiple weft-layer fabric for paper making; and especially on the running surface of the multiple weft-layer fabric for paper making.

Still further, the present invention relates to a wear-resistant multiple weft-layer fabric for paper making having wefts arranged in the multiple layers of the upper paper making surface and the lower running surface, wherein a combination of a conventional polyamide and/or a polyester monofilament and the extendable and heat shrinkable polyamide monofilament as described is arranged at least as a weft of the multiple weft-layer fabric for paper making; and especially wherein the extendable and heat shrinkable polyamide monofilament is arranged as a weft on the running surface of the multiple weft-layer paper making fabric.

The most important one of various factors for obtaining a paper making fabric exhibiting the aforementioned properties is the filament which constitutes the fabric. While the material of the filament itself has a large influence, physical properties possessed by the filament as a result of the treatment of the filament also have large effects. The filament for constituting the paper making fabric is preferably a synthetic resin filament in consideration of its resistance to wear and the rigidity.

The weft and warp of conventional synthetic monofilaments are bent or deformed by a weaving force during weaving, but they will return to their original linear shape as soon as the force is removed. The reason for this is that the bending which takes place in weaving is elastic deformation but not plastic deformation.

The extendable and heat shrinkable polyamide monofilament according to the present invention has properties quite different from such conventional monofilaments. That is, the extendable and heat shrinkable polyamide monofilament according to the present invention is a very special filament having a large extension and a large heat shrinkability. In other words, it is a novel monofilament which has hitherto been unknown and has special properties such as an extension of 6% or more to a loading variation of 1.25–1.75 g per denier (referred to hereinafter as g/d) and a heat shrinkability on immersing it into boiling water of 7% or more.

The aforementioned special, extendable and heat shrinkable polyamide monofilament according to the present invention can be prepared by controlling the extendibility, relaxation and treatment temperature of a filament to afford the aforementioned extension and a large heat shrinkability. The resulting polyamide monofilament has an excellent attitude stability and surface smoothness imparting effect on the fabric produced using same. Also, the paper making fabric according to the present invention has an improved structure by the use of the aforementioned polyamide monofilament, so that the paper making ability of the paper making surface is improved and the water drainage ability and wire marking property of the fabric are also substantially improved. Further, the quality of paper to be made on machinery using the endless fabric is improved.

As described in detail later, wear-resistant volume is not increased, as described above, merely by increasing the diameter of the weft. The shape of the crimp of the weft extruding over the running side of a paper making fabric is critical for the wear-resistant volume. If the fabric has a structure in which the weft is sufficiently bent, then the crimp of the weft has a rectangular shape in longitudinal cross-section and thus has a maximum effective wear-resistant volume. The weft itself has a cylindrical cross section. The warp which is not bent is not extended with tensile force and thus is effective for keeping the attitude of a fabric for paper making, since the fabric for paper making is subjected to an tensile force in the warp direction during its use. A fabric is formed by crossing warps and wefts, so that it is important for the fabric for paper making to have a structure wherein the warp is not bent, but the weft is sufficiently bent as described in relation to the warp.

The attitude stability of the fabric for paper making requires it to bear not only the tensile force in the warp direction but also loadings in any directions such as the weft direction or the vertical direction. Since a fabric is formed essentially by crossing warps and wefts and weaving them into a weave, the attitude stability of the whole fabric is substantially improved by fixing both warps and wefts at the state of being sufficiently crossed. That is, if the warps and the wefts can be fixed and set at the state of being crossed completely with each other by the sufficient bending of the wefts, excellent attitude stability of the fabric can be obtained, as is a molded article.

In this connection, no fabrics having these features have hitherto been known. Ordinary fabrics are required to have such fabric properties as flexibility, soft feel or good touch, and thus properties such as stretch or softness are necessary for the fabrics. On the other hand, attitude stability is rather shunned in spite of the necessity for it, since flexibility, soft feel or good touch will be lost from a fabric having an excessive attitude stability. Thus, the fabrics for paper making are required to have properties quite different from those of ordinary fabrics and belong to a special field. Therefore, the fact is that fabrics for paper making which satisfy the aforementioned requirements have not been found yet. Niether have filaments for constructing such fabrics been found.

The present invention provides a fabric for paper making which satisfies the aforementioned requirements. It has been found that such a fabric for paper making cannot be constructed with a filament which is used for ordinary fabrics and that a special filament must be used. Thus, a feature of the invention is an extendable and heat shrinkable polyamide monofilament for constructing fabrics for paper making. A further feature resides in a fabric for paper making having an excellent advantageous effect.

The special polyamide monofilament according to the present invention for forming a paper making fabric in which wefts are sufficiently bent and the whole of which is integrally fixed has an extension of 6% or more to a variation of loading from 1.25 g/d to 1.75 g/d and a heat shrinkage factor of 7% or more on immersing the monofilament into boiling water.

DETAILED DESCRIPTION OF THE INVENTION

Figure 1:
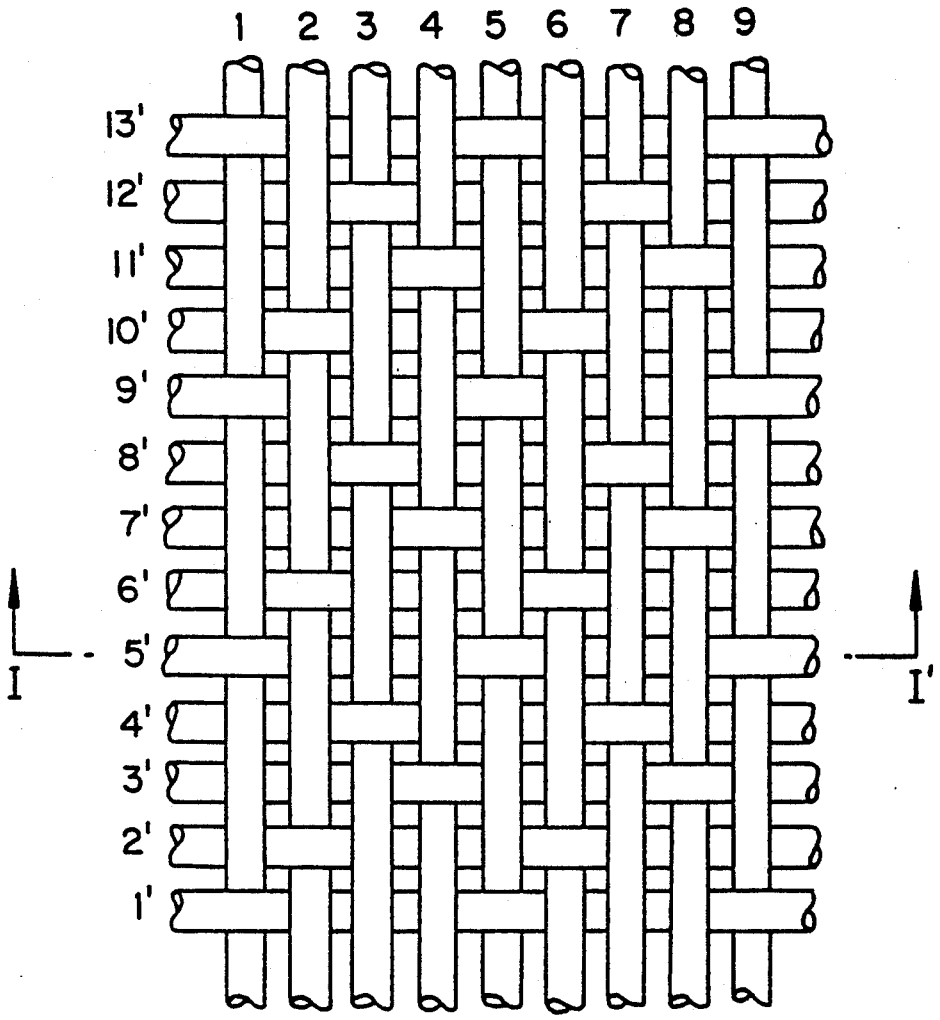
FIG. 1–FIG. 6 show the plan views and sectional views of the paper making fabric of the present invention.

The novel polyamide monofilament which is a feature of this invention was unknown prior to this invention. Ordinary polyamide monofilaments which do not satisfy the aforementioned requirements deform gradually and continuously and do not exhibit the behavior that deformation occurs for the first time on application of a specific loading. In contrast, the extendable and heat shrinkable polyamide monofilament according to the present invention has no yield point of plastic deformation, however, the monofilament exhibits a specific effect. That is, the monofilament of the invention is sufficiently bent by the weaving force of a textile weaving loom applied to the weft on weaving, deformed and crossed with the warp, so that the imparted deformation is not released even if the fabric is removed from the loom. Polyamide monofilaments which do not satisfy the aforementioned specific requirements are not bent sufficiently by the weaving force of a textile weaving loom applied on weaving. As a result, in conventional monofilaments, deformation which is elastic in nature is released gradually to return the polyamide monofilament to its original configuration when the fabric is removed from the loom. It is important that the extendable and heat shrinkable polyamide monofilament according to the present invention, which is different from conventional monofilaments, does not return to its original configuration even if loading or force is removed. Therefore, a fabric made with this filament as a weft is stabilized in a state in which the weft is sufficiently bent during weaving. Thus, a fabric very excellent in attitude stability and surface smoothness can be formed.

The polyamide monofilament of the invention is made by the following method of manufacturing:

ϵ—Caprolactam monomer is polymerized in the presence of a small amount of water and a catalyst according to the following equation:

$$\underbrace{NH(CH_2)_5CO}_{} + H_2O \rightleftharpoons H_2N(CH_2)_5COOH$$

$$H_2N(CH_2)_5COOH +$$

-continued $$(n-1)\underbrace{NH(CH_2)_5CO}_{} \xrightleftharpoons{300^\circ\ C.} H(NH(CH_2)_5CO)_nOH$$

The equilibulium constant K of the polymerization reaction is a large value, as indicated with the following equation, then the reaction proceeds to the right much more extensively.

$$K = \frac{(NHCO)(H_2O)}{(NH_2)(COOH)} = 300 \sim 400$$

The chemical structure of the polyamide is as follows:

$$CH_3CO(NH(CH_2)_5CO)_nOH$$

wherein n in the formula stands for the degree of polymerization.

The polymerization degree is between 100 to 150 and the molecular weight of the polyamide is 11300 ~ 16950.

The method of manufacturing the polyamide monofilament of the invention is as follows:

(1) Under melting yarn making conditions, the filament is extruded from yarn making nozzle of conventional design;

(2) Then the yarn is stretched at room temperature to a stretch degree of 2 to 4;

(3) The resulting monofilament, after heat setting if desired, has the physical characteristics described herein. Heat setting is not necessary in the case where the resulting monofilament already has the physical characteristics described herein. In other words, the physical characteristics of monofilament varies in accordance with degree of polymerization for polyamide, yarn making conditions, stretching degree, stretching temperature and the like. Therefore, heat setting can be carried out if necessary.

As the extendable and heat shrinkable polyamide monofilament of the present invention has, as described above, an extremely large heat shrinkability, it heat shrinks to a large extent and the weft is heat set in such a state that the weft holds the warp firmly in a sufficiently bent configuration to greatly improve the attitude stability of the fabric. In particular, the weft heat shrinks and is sufficiently bent on weaving so that the crimp of the weft has a rectangular shape, when viewed in longitudinal cross section, between the warps to greatly increase its effective wear-resistant volume. While the extendable and heat shrinkable polyamide monofilament having these characteristics increases resistance to wear when arranged as the weft on the running surface of a paper making fabric, the monofilament improves the quality of paper as it makes the surface smooth on being arranged on the paper making surface.

The paper making fabric of the present invention includes the so-called single-layer fabric in which the extendable and heat shrinkable polyamide monofilament is arranged as a weft in one layer and a multiple weft-layer paper making fabric in which the wefts are arranged in multiple layers. The extendable and heat shrinkable polyamide monofilament of the present invention may be used alone or in combination with other monofilaments. As suitable other monofilaments, there is mentioned conventional polyester monofilaments, polyamide monofilaments and the like. These conventional monofilaments may be used in such an amount as will not impair the advantageous effect obtained by using the special, extendable and heat shrinkable polyamide monofilament of the present invention.

The extendable and heat shrinkable polyamide monofilament of the present invention may be also arranged as warp or as both or warp and weft.

The monofilament of the present invention must have an extension of 6% or more to a variation of loading and a heat shrinkage factor of 7% or more on immersing the monofilament into boiling water. A polyamide monofilament having an extension of less than 6% deforms elastically, returns to its original configuration and loses flexibility when it is removed from a loom, and thus it cannot form a fabric in which the weft is sufficiently bent. When the monofilament has a heat shrinkage factor of less than 7%, the heat shrinkability is too little to get a preferred attitude stability or to form a preferred crimp upon being heat set. For instance, the conventional polyamide monofilament have an extension of 5% or less to a variation of loading in the range of 1.25 g/d–1.75 g/d and a heat shrinkage factor of at most 4.5% or less on immersing said monofilament into boiling water.

The effects and properties of the present invention are described successively with reference to the extendable and heat shrinkable polyamide monofilament and the paper making fabric.

The extendable and heat shrinkable polyamide monofilament of the present invention possesses properties such as plastic deformability and heat shrinkability and exhibits the effect that the width of the fabric does not shrink on weaving.

In other words, ordinary weft is deformed elastically and bent on weaving. The width of the fabric is kept due to the pressing the fabric with a reed. While the fabric elastically recovers and loses the deformation and the width is increased as soon as it removes from the loom, the warp of the fabric is stretched intensely to bend the weft to a greater extent than on weaving, so that the width shrinks greatly to lose the attitude stability as soon as the fabric is removed from the loom.

As the extendable and heat shrinkable polyamide monofilament of the present invention having an extension of 6% or more to a particular loading is a soft yarn, it is bent sufficiently and deformed at the state by the force applied on weaving and will not return to its original configuration upon removal of the loading. Therefore, the width of the fabric is not decreased when the fabric is removed from the loom, and the attitude is stabilized. Such advantageous effects are particularly preferable in an endless fabric which requires a precise size.

Next, the operation and advantageous effects are described with reference to the paper making fabric in which the extendable and heat shrinkable polyamide monofilament is used as the weft.

The working life of the paper making fabric is increased by increasing the wear-resistant volume of the weft which forms the running surface. Such effect is observed in both a single-layer fabric and a double weft-layer fabric. That is, the working life is at an end when the warp is worn and broken and as a result the running endless fabric is broken. It is necessary to avoid wear of the warp. Therefore, resistance to wear is to be imparted to the weft.

In order to increase the wear-resistant volume of the weft which forms the running surface, it may be sufficient that a weft having a large diameter is arranged as the weft. However, such an arrangement has the aforementioned defect and does not increase satisfactorily the effective wear-resistant volume. Also, if the length of the weft crimp, that is, the length of the weft protruding over the running surface between knuckles which are bent by the warps is increased, the wear-resistant volume ought to be increased. However, the present inventors have found that the wear-resistant volume will not always be increased only by increasing the length.

The present inventors have found that the apparent wear-resistant volume of the weft is very different from the effective wear-resistant volume of the weft and the mere increase of the apparent wear-resistant volume does not influence the wear-resistant effect.

That is, in the weft on the running surface of a practicable fabric, there are portions which exert no wear-resistant effect because of the crimp shape at the knuckle parts where warp and weft are crossed and the yarn is sharply bent.

One of the features of the fabric of the present invention resides in an extendable and heat shrinkable polyamide monofilament having a special property arranged as the weft of the running surface. The weft is sufficiently bent and protruded between the warps to increase the length of the weft crimp and to form the crimp having a rectangular shape in longitudinal cross section so that the portion of the weft which does not contribute any wear-resistant effect is decreased and the effective wear-resistant volume is increased extensively.

Another feature of the present invention resides in an extendable and heat shrinkable polyamide monofilament arranged as the weft of the running surface, wherein the weft is sufficiently bent at the knuckle parts and in a deformed state, so that the weft holds the warp and is heat set. As a result, the knuckle parts are fixed and the attitude stability is greatly improved.

A further feature of the present invention resides in an extendable and heat shrinkable polyamide monofilament being arranged as the weft on the running surface, wherein the weft is sufficiently bent at the knuckle parts and in a deformed state to hold the warp, so that the running surface of the fabric has a smooth surface and contacts uniformly with the foil of a paper making machine to improve the drainage property. Furthermore, the fabric has a good holding ability on guide rolls and thus the guiding property is improved. The effect of improving the guiding property is common to all endless fabrics.

Another feature of the present invention resides in the arrangement of the aforementioned weft on the paper making surface of the fabric thereby making the surface smooth and improving the quality of paper produced thereon, supporting ability for pulp fiber and wire-marking property.

The other important feature of the fabric for paper making of the present invention resides in the property of no edge curling of the paper making fabric. The most popular multiple-layer fabric for paper making at present comprises a relatively rigid yarn as the upper-layer weft to reduce deforming and to level the crimp with the warp. Thus, the upper-layer weft has a large heat shrinkage factor. On the other hand, the lower-layer weft is sufficiently bent and a long crimp is formed to increase the wear-resistant property so that the warp is prevented from exposure on the paper making surface and from wear. That is, the weft in the lower-layer has a small heat shrinkage factor. As the fabric has such a structure as described above, during the heat setting process the weft in the upper-layer having a large heat shrinkage factor is subjected to a shrinking force in the width direction and the lower weave is subjected to a force extending in the width direction, so that edge curling of the fabric occurred. Accordingly, when the extendable and heat shrinkable monofilament of the present invention is used as the lower-layer weft, it has a good crimping ability and a large shrinkage factor, the lower-layer weft is subjected to a shrinking force in the width direction at least in the same level as the upper-layer, and thus the edge curling of the fabric does not occur. If the edge curling occurs, not only does the fabric shrink in the width direction, but also the running position becomes hard to be controlled.

The paper making fabric of the present invention includes also a single-layer fabric comprising a single weft layer as well as the multiple-layer fabrics such as double or triple weft-layer fabrics. In the case of the multiple weft-layer fabric in which the wefts are arranged in the multiple layers, i.e., the paper making surface and the running surface, as is understood from the above described features, yarns suitable for the structures of respective surfaces can be arranged for the respective wefts. In this way the extendable and heat shrinkable polyamide monofilament of the present invention exhibits the effect most preferably and a multiple layered paper making fabric can be provided which is greatly improved in respect of the resistance to wear. While the fabric for paper making of the present invention is woven with use of a weft of the aforementioned special, extendable and heat shrinkable polyamide monofilament, the shrunk weft is fixed firmly and will not be extended or deformed if the fabric is once finished by heat setting after weaving.

The increase of the wear-resistant volume and the increase of the resistance to wear will be described specifically in the detailed description of the preferred embodiments with comparative examples of conventional fabrics.

The embodiments of the present invention is described with reference to the drawings, and then the comparative tests are also illustrated to explain the advantageous effect of the present invention.

In each drawing, the warps are represented by numerals such as 1, 2 or 3, the upper wefts are represented by numerals with prime such as 1', 2' or 3', and the lower wefts are represented by numerals with double prime such as 1'', 2'' or 3''.

Figure 2:
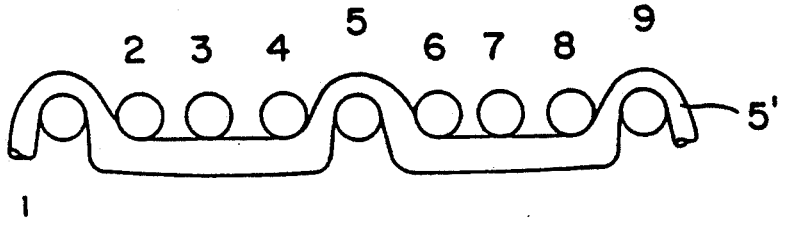

FIG. 1 is a plan view illustrating a part of the single woven fabric for paper making in which the extendable and heat shrinkable monofilament of the present invention is arranged as the weft. FIG. 2 is a sectional view taken along the line I - I' of FIG. 1, in which a weft 5' is woven with warps 1, 5 and 9 and passes under warps 2, 3 and 4 and 6, 7 and 8 to form crimps for three warps. The weft 5' is an extendable and heat shrinkable polyamide monofilament having special properties, i.e., large extension and large heat shrinkability and is bent and deformed sufficiently on weaving. It further shrinks intensely to form a crimp protruding from the lower surface between the warps 1 and 5, which exhibits the wearing effect. The weft is bent sufficiently and set, and thus it is understood that the weft holds the warps firmly and the warps are not exposed on the running surface. The weft 5' is bent almost vertically at the both sides of the warps 1, 5 and 9 by the extension effect and the heat shrinking effect, and the crimp of the weft has a rectangular shape in longitudinal cross section taken through the fabric. As will be understood from the shape of the rectangular shape in longitudinal cross section, the wear-resistant volume is a maximum. It will also be understood that the lower surface of the crimp is flat and the running surface is smooth.

Figure 3:
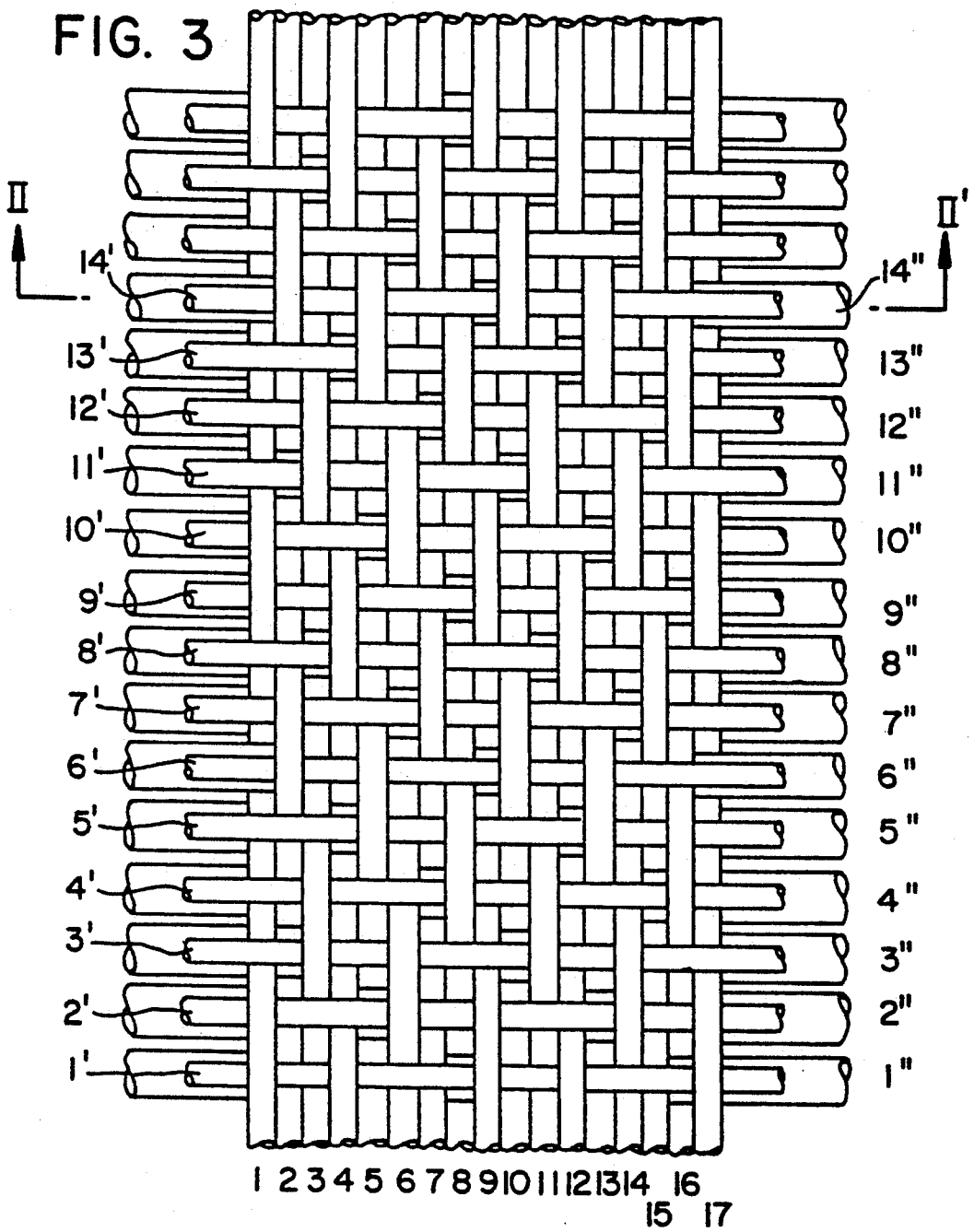

The embodiment in FIG. 3 shows a plan view illustrating a part of a double-layer fabric in which the extendable and heat shrinkable monofilament of the present invention is arranged as the lower-layer weft.

Figure 4:
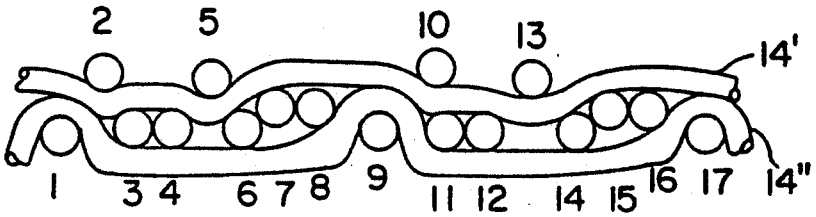

FIG. 4 is a sectional view taken along the line II - II' of the fabric shown in FIG. 3. In this embodiment, while the extendable and heat shrinkable monofilament is arranged as the lower-layer weft, a conventional polyester monofilament is arranged was the weft in the upper-layer. The lower-layer weft 14'' is woven with warps 1, 9 and 17 and passes under warps 2–8 and 10–16 to form a crimp for seven warps. The lower-layer weft 14'' is bent sufficiently and subjected to plastic deformation and it further shrinks intensely during the heat setting process, so that the crimp has a shape protruding largely from the lower surface between the warps 1 and 5. The crimp exhibits the wearing effect.

Also in this embodiment, the lower-layer weft is bent sufficiently and fixed in the same manner as the weft of the embodiment in FIG. 1, and thus it is understood that the weft holds the warps firmly and the warps are not exposed on the running surface.

The weft 14'' is bent almost vertically at both sides of the warps 1, 9 and 17 by the extension effect and the heat shrinking effect, and the crimp of the weft has a rectangular shape in longitudinal cross section. As will be apparent from this shape, the wear-resistant volume is a maximum. Also manifest is that the lower surface of the crimp is flat at the running surface making it smooth. On the other hand, the upper-layer weft 14' comprises a conventional polyester monofilament, and the crimp has a shape of a circular arc instead of a rectangular shape in longitudinal cross section. Thus, the upper-layer weft is different from the shape of the lower weft with no flat upper surface and no smooth fabric surface.

Furthermore, as the upper surface of the crimp is lower than the warps, the weft is subject to having a shape where the weft sinks down between the two warps. As a result, paper pulp tends to accumulate in the recess to form a mat. Although the fabric is excellent in resistance to wear and attitude stability, there is a risk that it may cause wire marks like conventional fabrics.

Figure 5:
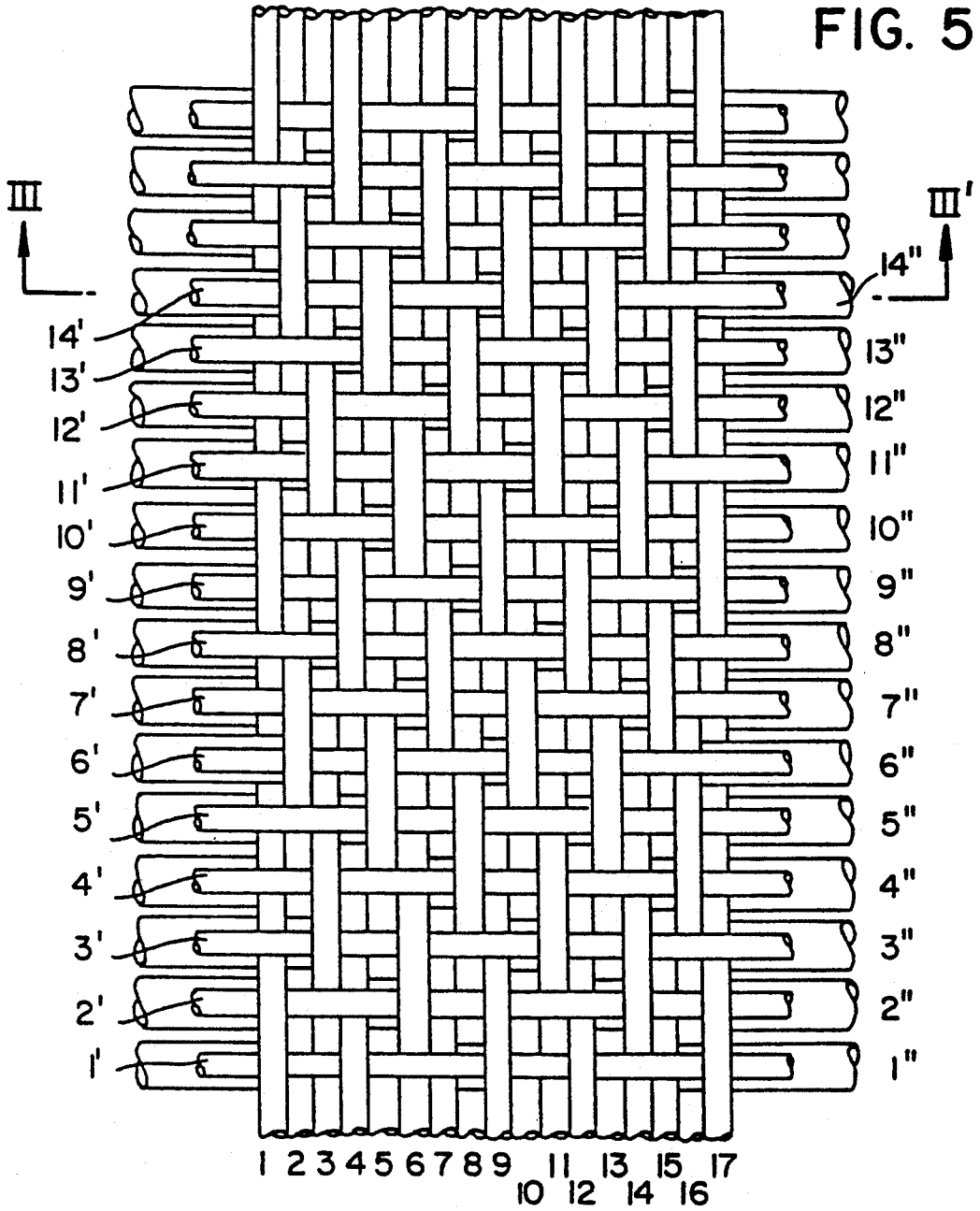

The embodiment in FIG. 5 is a plan view illustrating a part of the double-layer fabric for paper making in which the extendable and heat shrinkable monofilament of the present invention is arranged as both the upper-layer weft and the lower-layer weft.

Figure 6:
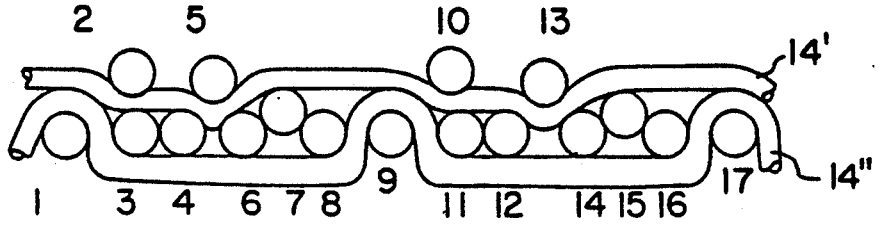

FIG. 6 is a sectional view which shows the section taken along the line III- III' of the fabric shown in FIG. 5. The fabric in this embodiment is the same fabric as that shown in FIG. 3 except that the fabric has an upper-layer weft different from that of the fabric shown in FIG. 3 and thus has a different paper making surface structure. In this embodiment, the extendable and heat shrinkable polyamide monofilament of the present invention which has a specific extension and a large heat shrinkability is arranged as both the upper and lower wefts. The lower-layer weft 14" is woven by warps 1, 9 and 17 and passes under warps 2–8 and 10–16 to form a crimp for seven warps. The lower-layer weft 14" is bent sufficiently and fixed and it further shrinks intensely during the heat setting process, so that the crimp extrudes largely from the lower surface between the warps 1 and 5 and has a rectangular shape in longitudinal cross section taken through the fabric. The crimp exhibits the wearing effect.

Also in this embodiment, the lower-layer is bent sufficiently and fixed in the same manner as the weft of the embodiment in FIG. 1, and thus it is understood that the weft holds the warps firmly and the warps are not exposed on the surface of the running surface.

The weft 14" is bent almost vertically at the both sides of the warps 1, 9 and 17 by the extension effect and the heat shrinking effect, and the crimp of the weft has a rectangular shape in longitudinal cross section. The weft itself has a cylindrical shape in cross section. Because of this shape, the wear-resistant volume is at a maximum. As will be apparent, the lower surface of the crimp is flat and the running surface is smooth. On the other hand, the upper-layer weft 14' is woven into the weave by the warps 2 and 5 and passes over the warps 3 and 4 to form a crimp for two warps protruding from the lower surface. In the same manner, a crimp for two warps between the warps 10 and 13 is formed as well. A crimp for four warps which extrudes from the upper surface is also formed by the weft passing over warps 6, 7, 8 and 9 between the warps 5 and 10. The upper-layer weft yarn 14" comprises the extendable and heat shrinkable polyamide monofilament of the present invention, so that the crimp has a rectangular shape in longitudinal cross section and a flat upper surface in the same manner as the lower-layer weft by the extension effect and the heat shrinking effect.

Moreover, the crimp, which protrudes largely between the warps, has the same level as the warps, and the weft does not have a shape of sinking down between the warps, so that no recess is formed between the warps. Thus, the accumulation of paper pulp or the formation of pulp mat in the recess are not observed, and thus wire marks are not generated.

Figure 7:
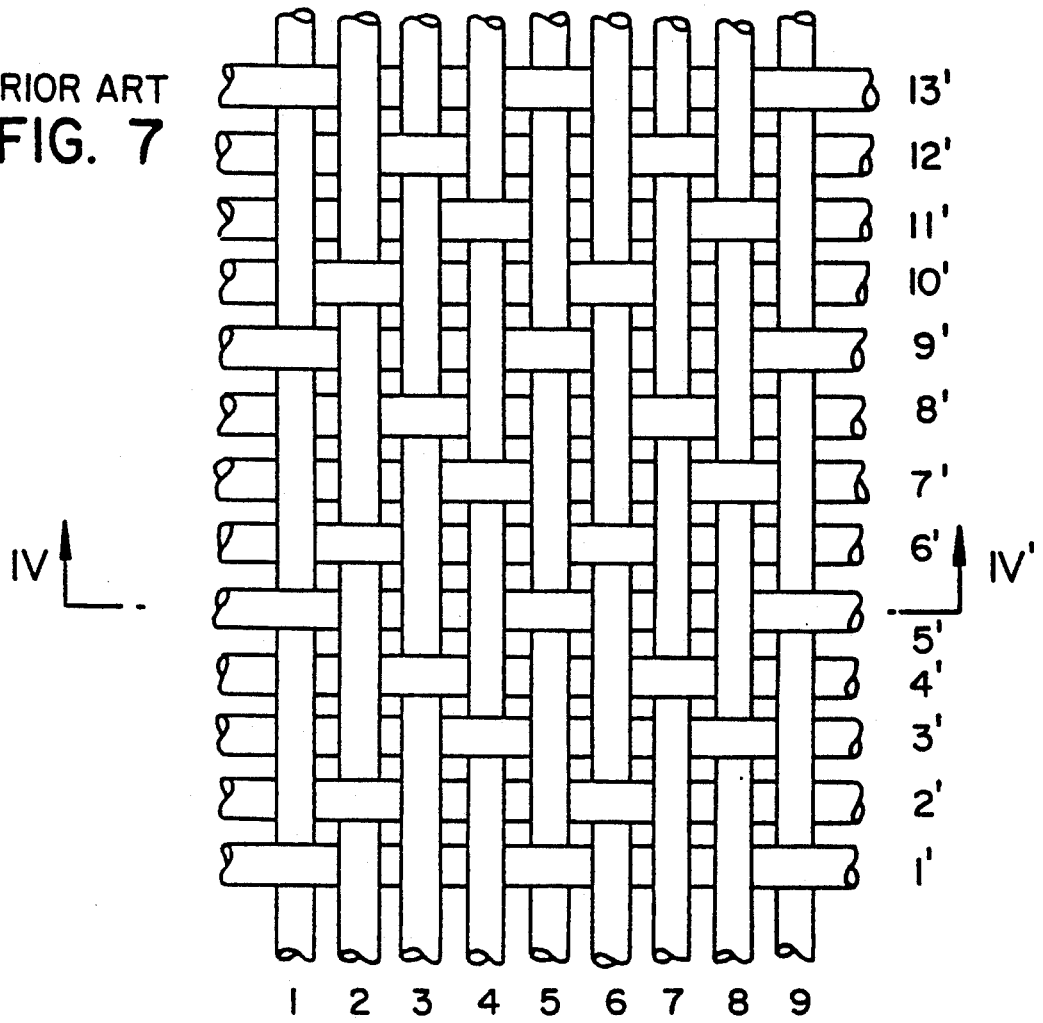
PRIOR ART FIG. 7
FIG. 7–FIG. 10 show the plan views and sectional views of the prior art paper making fabrics.

FIG. 7 is a plan view illustrating a part of a conventional prior art fabric for paper making. The filament used is an ordinary polyester monofilament.

Figure 8:
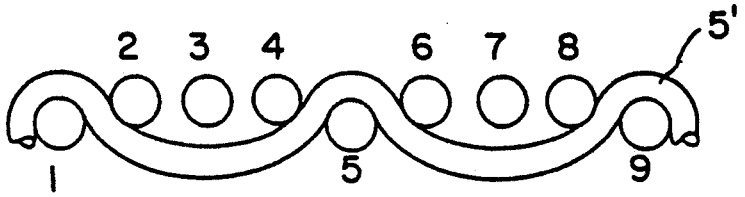
PRIOR ART FIG. 8

FIG. 8 is a sectional view taken along the line IV - IV' of the fabric shown in FIG. 7. The weft 5' is woven by warps 1, 5 and 9 and passes under warps 2, 3 and 4 to form a crimp protruding downwards. However, the crimp is formed by the elastic deformation of the monofilament which is different from the monofilament of the present invention and has a small heat shrinkability. Therefore, the conventional monofilament deforms only gradually and forms a crimp in the shape of circular arc which protrudes downwards but does not form a crimp which is bent almost vertically at both sides of the warps. As will be understood from the figure, wear initiates from the arcuate protrusion of the crimp and the weft at the both sides of the warps exhibits a very small wear-resistant volume as compared with the crimp having a rectangular shape in longitudinal cross section in the fabric of the present invention.

Figure 9:
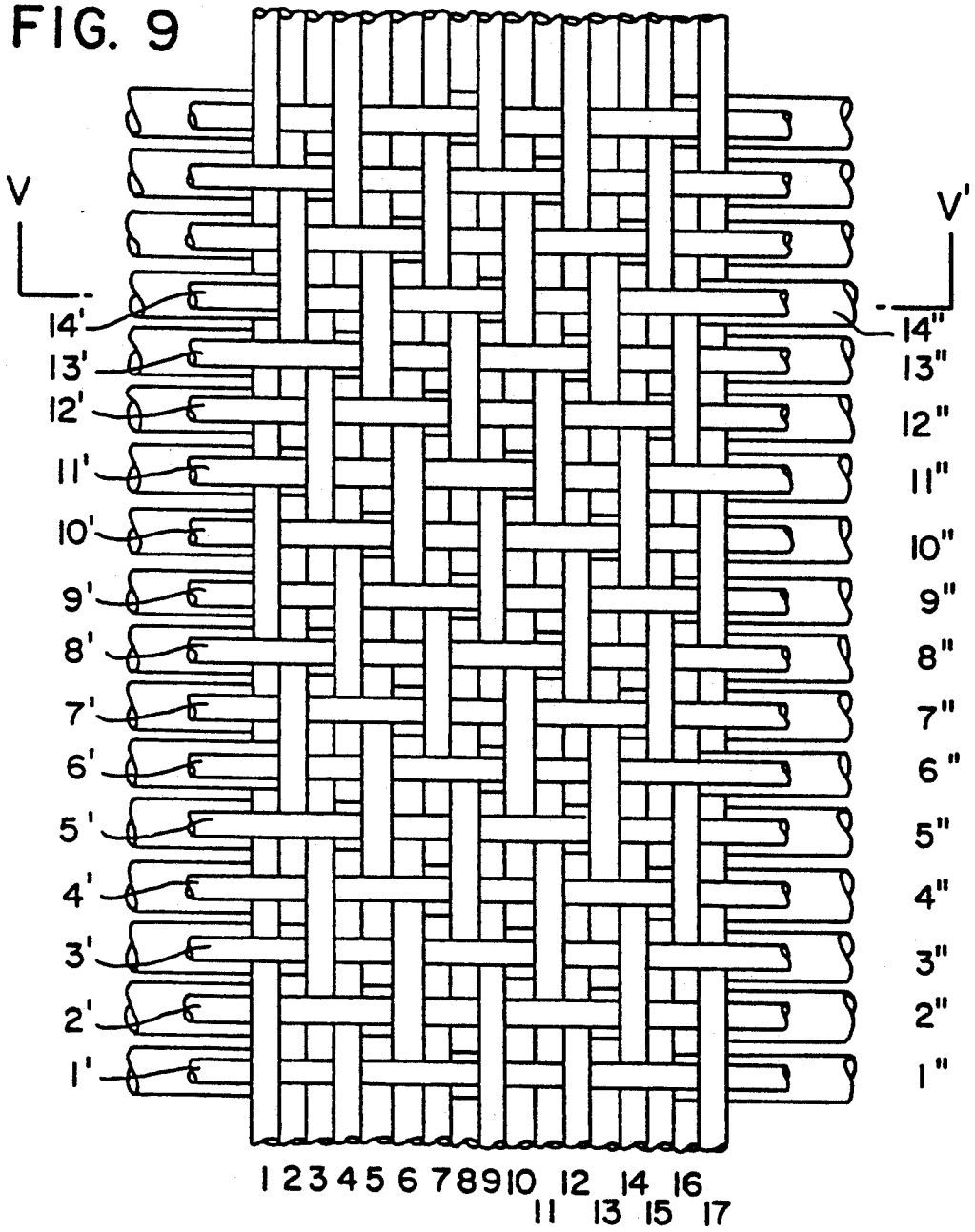
PRIOR ART FIG. 9

FIG. 9 is a plan view of a part of a conventional prior art double-layer fabric for paper making. The filament used is an ordinary polyester monofilament.

Figure 10:
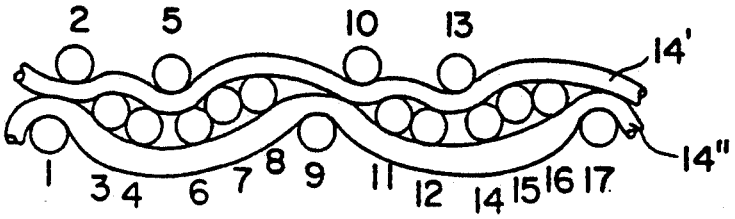
PRIOR ART FIG. 10

FIG. 10 is a sectional view taken along the line V - V' of the fabric shown in FIG. 9. The lower-layer weft 14" is woven by warps 1, 9 and 17 and passes under warps 2–8 and 10 –16 to form a crimp for seven warps. However, the crimp is formed by the elastic deformation of the monofilament which is different from the monofilament of the present invention. It has small heat shrinkability, so that the conventional monofilament deforms only gradually and forms a crimp in the shape of circular arc which protrudes downwards but does not have a crimp which has a rectangular shape in longitudinal cross section, as is the case in the paper making fabric of the present invention. As will be apparent from the figure, wear initiates from the arcuate protrusion of the crimp and the weft at both sides of the warps amd exhibit a very small wear-resistant volume as compared with the crimp having a rectangular shape in longitudinal cross section of the fabric of the present invention.

On the other hand, the upper-layer weft 14' comprises a conventional polyester monofilament like the lower weft 14". Therefore, the monofilament, different from the one of the present invention, deforms only elastically and has a small heat shrinkability. The conventional monofilament deforms only gradually and forms a crimp in the shape of circular arc which protrudes upwards. It does not form a crimp which has such a rectangular shape in longitudinal cross section as in the paper making fabric of the present invention. It is also found that the upper surface is not flat; nor is the surface of the fabric smooth.

Furthermore, as the upper surface of the crimp is lower than the warps, the weft is subject to having a shape such that the weft sinks down between the two warps. Thus, paper pulp tends to accumulate at the recess to form a pulp mat and generate a wire mark.

As described above, the present invention has been typically described with respect to paper making fabrics as endless fabrics which require the most demanding properties, wherein the endless fabrics have arranged therein the extendable and heat shrinkable polyamide monofilament forming a fabric the upper surface and the lower surface of which are flat. On the lower surface, a crimp having an extremely large wear-resistant volume is formed. The resistance to wear is also improved and the fabric is firmly held in place because the weft is sufficiently bent to be thoroughly entwined with the warp. Thus, the attitude stability is also improved extensively. The advantageous effect of the present invention will now be specifically described with reference to the comparison test of the conventional endless fabric and the one according to the present invention.

COMPARISON TEST OF EFFECTS

Example 1

A conventional polyester monofilament yarn having a diameter of 0.17 mm was used as a warp, the polyamide (Nylon 6) monofilament of the present invention having a diameter of 0.17 mm, an extension of 6.5% to a variation of loading from 1.25 g/d to 1.75 g/d and a heat shrinkage factor of 7.2% on immersing the monofilament into boiling water is arranged as an upper weft. The polyamide (Nylon 6) monofilament of the present invention having a diameter of 0.22 mm, an extension of 9.3% to a variation of loading from 1.25 g/d to 1.75 g/d and a heat shrinkage factor of 12.5% on immersing the monofilament into boiling water and a conventional polyester monofilament yarn having a diameter of 0.22 mm are alternately arranged, and these yarns were woven to prepare an eight shaft weft double-layer fabric, which was subjected to heat setting to give Sample 1 as an example of the present invention. The textile design and configuration of Sample 1 are shown in FIGS. 5 and 6, and the yarn density and other properties are shown in Table 1.

In contrast, the same warp as that in the aforementioned fabric was used and an ordinary yarn of a polyamide (Nylon 6) monofilament having the same diameter as above was arranged as the upper yarn, an ordinary polyester monofilament having the same diameter as above and an ordinary polyamide (Nylon 6) monofilament were alternately arranged as the lower wefts. These yarns were woven to prepare a fabric of an eight shaft weft double weave, which was heat set to give a conventional example 1. The textile design and configuration of the conventional example 1 are shown in FIGS. 9 and 10. The yarn density and other properties are shown in Table 1. Test results of these two fabrics are shown in Table 1.

TABLE 1

| | Sample 1 | Conventional Example 1 |
|---|---|---|
| Warp density (No. of yarns/inch) | 155 | 155 |
| Upper weft density (No. of yarns/inch) | 58 | 58 |
| Lower weft density (No. of yarns/inch) | 58 | 58 |
| Sheet smoothness*1 (second) | 89 | 77 |
| Wear-resistant volume on running surface*2 (mm/inch$^2$) | 25 | 16 |
| Edge curling amount*3 (mm) | 0 | 9 |
| Lifetime Ratio*4 | 140 | 100 |

[Notes]

*1Sheet smoothness: A paper sheet having a real weight corresponding to 70 g/m$^2$ was prepared from a raw material pulp incorporated with a mechanical paper with the TAPPI standard sheet test machine, and a smooth sheet was produced by the usual method to determine the smoothness of the paper surface in contact with the fabric surface by the Bekk smoothness tester.

*2Wear-resistant volume on running surface: Volume of the warp and the weft in which the sectional area of the warp on the running surface amounts to 50% of the sectional area of the fabric.

*3Edge curling amount: Variation of the height from the level part to the edge part of the fabric when a fabric was made endless, set on two rolls with a tension of 12 kg/cm and dipped into water.

*4Lifetime Ratio: Measurement was conducted with ground calcium carbonate as a filler by a wear tester (manufactured by NIPPON FILCON K.K.; Registered Utility Model No. 1350124).

Example 2

A conventional polyester monofilament yarn having a diameter of 0.20 mm was used as a warp, a conventional polyester monofilament yarn having a diameter of 0.19 mm was used as a upper weft, and the polyamide (Nylon 6) monofilament of the present invention having a diameter of 0.22 mm, an extension of 9.3% to a variation of loading from 1.25 g/d to 1.75 g/d and a heat shrinkage factor of 12.5% on immersing the monofilament into boiling water are alternately arranged, and these yarns were woven to prepare an eight shaft weft double-layer fabric, which was subjected to heat setting to give Sample 2 as an example of the present invention. The textile design and configuration of Sample 2 are shown in FIGS. 3 and 4.

In contrast, the same warp and upper weft as those in the aforementioned fabric were used and an ordinary yarn of a polyamide (Nylon 6) monofilament having the same diameter as above was arranged, and these yarns were woven into a fabric of an eight shaft weft double-layer weave, which was heat set to give a conventional example 2. The textile design and configuration of the conventional example are shown in FIGS. 9 and 10, and the yarn density and the other properties are also shown in Table 2. The test results of these two fabrics are also shown in Table 2.

TABLE 2

| | Sample 2 | Conventional Example 2 |
|---|---|---|
| Warp density (No. of yarns/inch) | 148 | 148 |
| Upper weft density (No. of yarns/inch) | 50 | 50 |
| Lower weft density (No. of yarns/inch) | 50 | 50 |
| Sheet smoothness*1 (second) | 75 | 70 |
| Wear-resistant volume on running surface*2 (mm/inch$^2$) | 25 | 11 |
| Edge curling amount*3 (mm) | 0 | 15 |
| Lifetime Ratio* | 189 | 100 |

[Notes]

*1Sheet smoothness: A paper sheet having a real weight corresponding to 70 g/m$^2$ was prepared from a raw material pulp incorporated with a mechanical paper with the TAPPI standard sheet test machine, and a smooth sheet was produced by the usual method to determine the smoothness of the paper surface in contact with the fabric surface by the Bekk smoothness tester.

*2Wear-resistant volume on running surface: Volume of the warp and the weft in which the sectional area of the warp on the running surface amounts to 50% of the sectional area of the fabric.

*3Edge curling amount: Variation of the height from the level part to the edge part of the fabric when a fabric was made endless, set on two rolls with a tension of 12 kg/cm and dipped into water.

*4Lifetime Ratio: Measurement was conducted with ground calcium carbonate as a filler by a wear tester (manufactured by NIPPON FILCON K.K.; Registered Utility Model No. 1350124).

Example 3

A conventional polyester monofilament yarn having a diameter of 0.25 mm was used as a warp, and the polyamide (Nylon 6) monofilament of the present invention having a diameter of 0.30 mm, an extension of 6.5% to a variation of loading from 1.25 g/d to 1.75 g/d and a heat shrinkage factor of 8.0% on immersing the monofilament into boiling water was used as a weft. These yarns were woven to prepare a fabric of four shaft 3/1 broken twill weave, which was subjected to heat setting to give Sample 3 as an example of the present invention. The textile design and configuration of Sample 3 are shown in FIGS. 1 and 2, and the yarn density and other properties are shown in Table 3.

In comparison, the same warp as that in the aforementioned fabric was used and an ordinary yarn of a polyamide (Nylon 6) monofilament having the same diameter as above was arranged as a weft, and these yarns were woven to prepare a fabric of four shaft 3/1 broken twill, which was heat set to give a conventional example 3. The textile design and configuration of the conventional example 3 are shown in FIGS. 7 and 8. The yarn density is shown in Table 3. Test results of these two fabrics are shown in Table 3.

TABLE 3

| | Sample 3 | Conventional Example 3 |
|---|---|---|
| Warp density (No. of yarns/inch) | 56 | 56 |
| Upper weft density (No. of yarns/inch) | 45 | 45 |
| Sheet smoothness*1 (second) | 69 | 62 |
| Wear-resistant volume on running surface*2 (mm/inch$^2$) | 43 | 30 |
| Edge curling amount*3 (mm) | 0 | 4 |

TABLE 3-continued

| | Sample 3 | Conventional Example 3 |
|---|---|---|
| Lifetime Ratio*4 | 133 | 100 |

[Notes]

*1Sheet smoothness: A paper sheet having a real weight corresponding to 70 g/m$^2$ was prepared from a raw material pulp incorporated with a mechanical paper with the TAPPI standard sheet test machine, and a smooth sheet was produced by the usual method to determine the smoothness of the paper surface in contact with the fabric surface by the Bekk smoothness tester.

*2Wear-resistant volume on running surface: Volume of the warp and the weft in which the sectional area of the warp on the running surface amounts to 50% of the sectional area of the fabric.

*3Edge curling amount: Variation of the height from the level part to the edge part of the fabric when a fabric was made endless, set on two rolls with a tension of 12 kg/cm and dipped into water.

*4Lifetime Ratio: Measurement was conducted with ground calcium carbonate as a filler by a wear tester (manufactured by NIPPON FILCON K.K.; Registered Utility Model No. 1350124).

As is apparent from the Examples described above, the fabric of the present invention, as compared with that of the conventional example, has excellent smoothness of fabric surface, exhibits no edge curling, shows excellent running ability, and has extensively improved working life by the increase of the wear-resistant volume on the running surface.

We claim:

1. An extendable and heat shrinkable polyamide monofilament which has an extension of 6% or more to a loading variation in the range of 1.25 g/d–1.75 g/d and a heat shrinkage factor of 7% or more on immersing said monofilament into boiling water.

2. The extendable and heat shrinkable polyamide monofilament according to claim 1 which has an extension of 6% or more to a loading variation in the range of 1.25 g/d–1.75 g/d on applying a load at a rate of 2 mm/min.

3. An endless fabric comprising a plurality of warps and wefts and containing at least as a weft the extendable and heat shrinkable polyamide monofilament according to claim 1.

4. A wear-resistant fabric for paper making, comprising, a plurality of warps and wefts woven into a fabric and containing at least as a weft, the extendable heat shrinkable polyamide monofilament according to claim 1.

5. An endless multiple weft-layer fabric having wefts arranged in upper and lower layers, wherein the extendable and heat shrinkable polyamide monofilament according to claim 1 is arranged at least as a weft of the endless multiple weft-layer fabric.

6. A wear-resistant multiple weft-layer fabric for paper making having wefts arranged in the multiple layers of the upper paper making surface and the lower running surface, wherein the extendable and heat shrinkable polyamide monofilament according to claim 1 is arranged at least as a weft of the multiple weft-layer fabric for paper making.

7. The wear-resistant multiple weft-layer fabric according to claim 6 wherein the extendable and heat shrinkable polyamide monofilament is arranged at least as a weft on the running surface of the multiple weft-layer fabric for paper making.

8. A wear-resistant multiple weft-layer fabric for paper making having wefts arranged in the multiple layers of the upper paper making surface and the lower running surface, wherein a combination of a conventional polyamide and/or a polyester monofilament and the extendable and heat shrinkable polyamide monofilament according to claim 1 is arranged at least as a weft of the multiple weft-layer fabric for paper making.

9. The wear-resistant multiple weft-layer fabric according to claim 8 wherein the heat shrinkable polyamide monofilament is arranged at least as a weft on the running surface of the multiple weft-layer fabric for paper making.

10. The extendable and heat shrinkable polyamide mono-filament according to claim 1 which has an extension of 6.5% to 9.3% to a loading variation in the range of 1.25 g/d–1.75 g/d and a heat shrinkage factor of 7.2% to 12.5% on immersing said mono-filament into boiling water.

11. An endless fabric comprising a plurality of warps and wefts and containing at least as a weft the extendable and the heat shrinkable polyamide mono-filament according to claim 10.

12. An endless multiple weft-layer fabric having wefts arranged in upper and lower layers, wherein the extendable and heat shrinkable polyamide mono-filament according to claim 10 is arranged at least as a weft of the endless multiple weft-layer fabric.

* * * * *